United States Patent [19]

Bresie et al.

[11] 4,380,242

[45] * Apr. 19, 1983

[54] METHOD AND SYSTEM FOR DISTRIBUTING NATURAL GAS

[75] Inventors: Don A. Bresie; Donald W. Fowler; Jack M. Burns, all of Austin, Tex.

[73] Assignee: Texas Gas Transport Company, Tex.

[ * ] Notice: The portion of the term of this patent subsequent to Jul. 22, 1997, has been disclaimed.

[21] Appl. No.: 267,998

[22] Filed: May 28, 1981

Related U.S. Application Data

[62] Division of Ser. No. 88,516, Oct. 26, 1979, abandoned.

[51] Int. Cl.[3] ..... F17C 5/02

[52] U.S. Cl. ..... 137/113; 137/561 R; 137/565

[58] Field of Search ..... 137/2, 113, 561 R; 166/75 R, 314; 62/55; 48/190

[56] References Cited

U.S. PATENT DOCUMENTS

| | | | |
|---|---|---|---|
| 2,518,894 | 8/1950 | Humbarger | 137/113 |
| 2,966,920 | 1/1961 | Oglesby | 137/113 |
| 4,139,019 | 2/1979 | Bresie | 137/561 R X |
| 4,213,476 | 7/1980 | Bresie | 137/2 |

*Primary Examiner*—Alan Cohan

*Attorney, Agent, or Firm*—Francis B. Francois; Francis D. Thomas, Jr.

[57] ABSTRACT

A user terminal is provided with two off-loading stations, and at least two separate pressure vessel means are employed to supply natural gas to the user terminal. At least one of the separate pressure vessels is movable to a supply terminal. The off-loading stations are preferably provided with an automatic switchover arrangement to change from one pressure vessel means to another, and the resulting method and system for distributing natural gas assures a continuous supply of natural gas at varying demand rates to the user terminal.

10 Claims, 4 Drawing Figures

METHOD AND SYSTEM FOR DISTRIBUTING NATURAL GAS

This application is a division of application Ser. No. 88,516, filed Oct. 26, 1979, now abandoned.

TECHNICAL FIELD OF THE INVENTION

This invention relates generally to a method and system for distributing natural gas from a supply terminal to one or more user terminals. More specifically, it relates to a method and system for distributing natural gas to user terminals without the need for a pipeline, and which will assure delivery of the gas with effectively no service interruptions and in a manner that maximizes the amount of natural gas that can be moved per unit of labor.

BACKGROUND OF THE INVENTION

Natural gas is one of the most desirable fuels, and extensive quantities of it are available from wells located around the world. In the past, natural gas was gathered from gas wells by a pipeline system and transported to a terminal facility or directly to users. More recently, methods and systems have been devised for moving large amounts of natural gas to a terminal facility by means other than pipelines, for subsequent distribution to users. Among such methods and systems are those employing liquefaction of the natural gas, such as the techniques disclosed in U.S. Pat. Nos. 3,232,725 and 3,298,805, and the high pressure transport technique disclosed in U.S. Pat. No. 4,139,019, the inventors of which are also inventors in this application. These newer techniques for moving natural gas from the gas well, and especially that of U.S. Pat. No. 4,139,019, have opened up large numbers of so-called shut-in wells to the recovery of natural gas, thus greatly increasing the quantity of the fuel potentially available for use.

In our U.S. patent application Ser. No. 011,683, filed Feb. 12, 1979, we disclosed a method and system for assuring the optimum recovery of natural gas from gas wells, employing the high pressure transport technique of U.S. Pat. No. 4,139,019. That invention further contributes to the availability of natural gas as a fuel.

In this time of energy shortage, efforts are being made to fully utilize all available natural gas. Given the use of pipelines, liquefied natural gas techniques, and the new high pressure transport techniques developed by the present inventors, it is now possible to recover much larger quantities of natural gas from wells than was heretofore believed possible. There now remains the problem of adequately distributing the recovered gas to potential users, so that this now more abundant energy source can be more fully utilized.

Many potential users of natural gas are located where pipeline construction is very difficult and expensive, such as in established urban areas. Other potential users are scattered in relatively small numbers across a large geographic area, and the economics required to support pipeline construction are simply not present. In the latter category of users will be found, for example, manufacturing plants, schools, hotels, and the like located in rural areas, nearly all of which could utilize natural gas for energy if it were available. The situation also exists where there are in fact a sufficient number of users located so that pipeline construction might be feasible, but where capital financing will not be made available until an adequate market is proven to exist. In these instances, pipeline construction might well occur if the market could first be established, at least in part.

Currently, many potential users of natural gas falling in the noted categories are using propane, fuel oil, electricity and coal to meet their energy needs. In many instances, the use of natural gas would be more desirable if it could be made available. Natural gas is an especially clean fuel and, in older urban areas, significant improvements in air quality can be obtained by substituting it for coal or oil. And as natural gas becomes more available for the reasons noted earlier, it can be expected that in many cases it will prove more economical than propane or electricity, for example.

The problem which must be solved is how to effectively and efficiently distribute natural gas from a supply terminal to potential users, without the building of a pipeline network. Accompanying the need to transport natural gas to consumers is the need to do so in such a manner as to maintain a continuous and trouble-free supply. It is known that interruption of natural gas service, once an installation has become reliant upon it, can be both an inconvenience and a safety hazard. Given that natural gas demand can vary significantly from hour to hour and day to day, the distribution technique must be able to meet a varying demand, and at the same time be reliable and cost efficient. The present invention provides a method and system for distributing natural gas which addresses and solves all of these problems.

BRIEF SUMMARY OF THE INVENTION

In the present invention, natural gas is distributed from a supply terminal. The supply terminal can be located on a pipeline connected to a natural gas field, or it can be a dockside facility for receiving natural gas transported to the dock in a liquefied state by large ships, a terminal to which natural gas has been transported by the high pressure technique of U.S. Pat. No. 4,139,019, or a similar installation. The distribution method of the invention begins at the supply terminal, and is designed to supply one or more user terminals located at a distance therefrom.

A first step of the method is to analyze the user terminal(s) to determine the amount of natural gas required over a given period of time, the expected fluctuations in demand, and other demand-related factors. Taking this data and integrating it with transport information such as the distance to be traveled, traffic conditions, the type and kinds of transport equipment available, the quantity and preferred flow rate of natural gas available at the supply terminal, and other factors, a distribution plan is drawn. The distribution plan identifies the type and number of transport pressure vessel means required, the delivery schedules which must be followed, and similar information.

The present invention draws upon the high pressure transport techniques described in U.S. Pat. No. 4,139,019, modified to accommodate the demands for an efficient and effective natural gas distribution technique. It also draws upon some of the concepts described in our U.S. patent application Ser. No. 011,683, noted above, in particular as to the equipment for assuring automatic transfer between two different pressure vessel means so as to assure an uninterrupted flow of natural gas to the user terminal.

The system of the present invention includes at least two pressure vessel means, at least one of which is movable between the supply terminal and the user terminal being serviced. The other pressure vessel means can also be movable or, if desired, it can be permanently positioned at the user terminal assuming other factors in the distribution plan so allow. The movable pressure vessel means is loaded with natural gas at the supply terminal in accordance with the principles set forth in U.S. Pat. No. 4,139,019 and, where applicable, our earlier U.S. patent application Ser. No. 011,683. The movable pressure vessel means is then transported to the user terminal, where off-loading of the natural gas occurs.

The transporting steps of the present invention are taken in accordance with the distribution plan, and the user terminal is equipped with a novel arrangement of components designed to assure proper functioning of the invention. The system at the user terminal normally will include pressure regulating equipment, a safety controller valve arrangement, and a heater for the natural gas, along with associated flow control equipment. Provisions are made for switching between connected pressure vessel means, and preferably the system will include an automatic switchover arrangement to ensure that the flow of natural gas to the user terminal will not be interrupted.

It is the principal object of the present invention to provide an improved method and system for distributing natural gas from a supply terminal to a user terminal(s), wherein service disruptions are minimized and the maximum response to demand variations is assured.

Another object is to provide a method and system for distributing natural gas which will minimize the per unit labor cost for transporting natural gas, and which assures an economical supply of natural gas to user facilities not located on a pipeline.

Yet another object is to provide a distribution method and system which can be economically employed to establish and develop markets for the use of natural gas, preparatory to the building of a pipeline network to service the user facilities.

A further object is to provide a method and system for distributing natural gas which minimizes personnel requirements and includes provisions to assure operating safety.

Other objects and many of the attendant advantages of the invention will become readily apparent from the following description of the preferred embodiments, when taken in conjunction with the accompanying drawings.

DETAILED DESCRIPTION OF THE PREFERRED EMBODIMENTS

In U.S. Pat. No. 4,139,019, there is disclosed apparatus for safely loading a discrete batch of natural gas into pressure vessel means, normally under a pressure of about 2,000 to 2,500 psi. It is contemplated that the high pressure transport technique of this patent will be employed in the present invention. Thus, all aspects involved in the loading of the pressure vessel means will not be described herein, but rather reference is made to U.S. Pat. No. 4,139,019.

As is described in U.S. Pat. No. 4,139,019, the pressure vessel means can take several different forms. For example, such can consist of a number of interconnected pressure vessels mounted on a truck for over-the-road movement, or upon a railroad car, or even a boat. For purposes of describing the present invention, the movable pressure vessel means is herein assumed to be a number of interconnected pressure vessels mounted for transport on a semitrailer, but it is understood that other arrangements are possible.

In the present distribution method and system, the natural gas is loaded in discrete batches into the movable pressure vessel means at a supply terminal. As mentioned earlier, the supply terminal can be a pipeline terminal, or some other terminal facility to which natural gas is supplied. The invention provides for distribution of the natural gas to one or more user terminals, and these can also assume different forms. For example, a user terminal can be the inlet of a manufacturing plant's pipeline system, the inlet pipe for the pipeline distribution system of a housing project or subdivision, the inlet for the natural gas energy system of a power plant or hospital, or any similar installation to which it is desired to supply natural gas.

Figure 1:
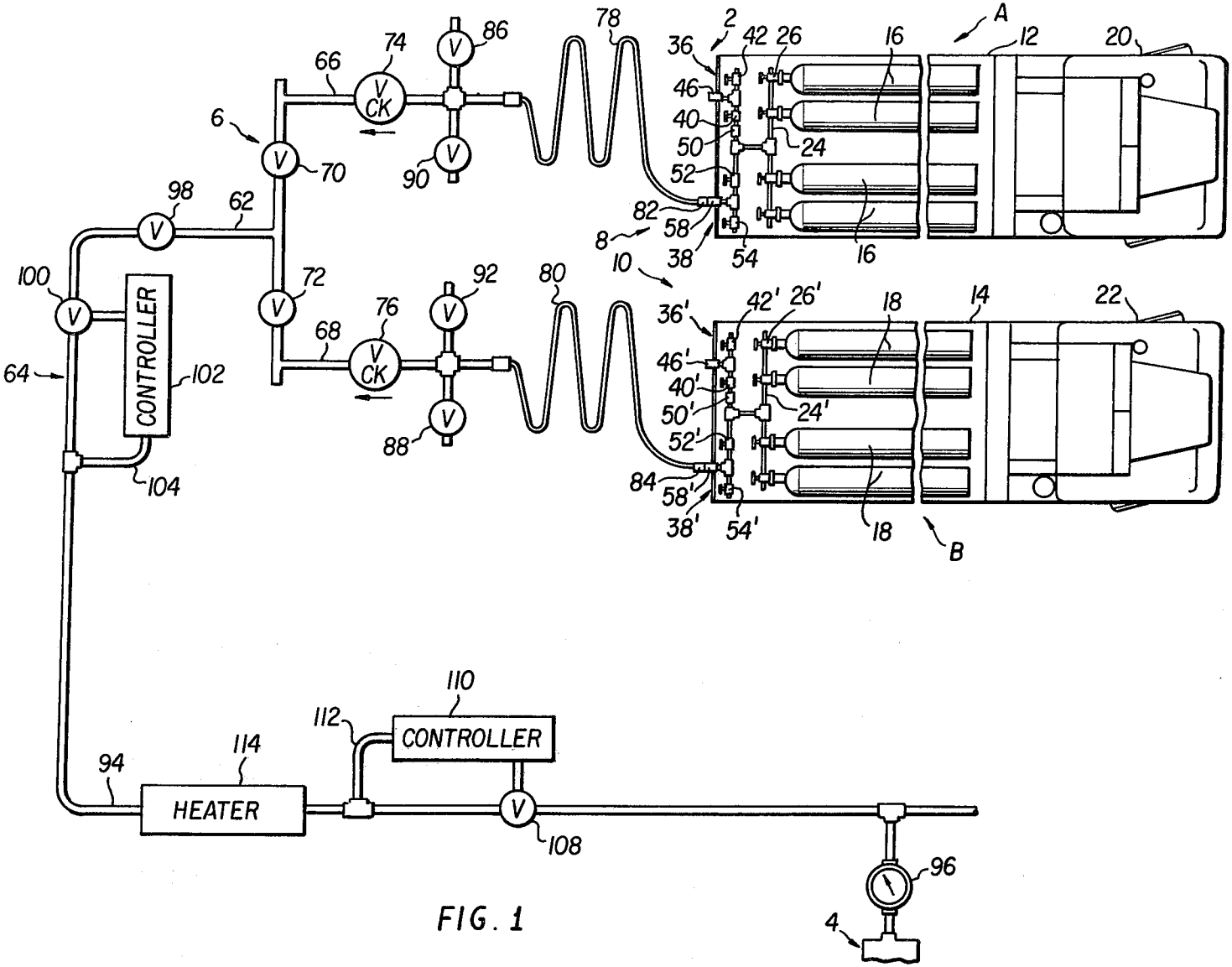
FIG. 1 is a diagrammatic view of a first embodiment of the off-loading terminal of the invention, showing the apparatus of the system for off-loading natural gas to the user terminal.

Referring now to FIG. 1 of the drawings, an off-loading terminal is indicated generally at 2, located adjacent a user terminal 4. The off-loading terminal 2 includes a manifold system 6 having two off-loading locations or stations 8 and 10, for receiving high pressure vessel means A and B to be unloaded. In the drawings the pressure vessel means A and B respectively comprise semitrailer vehicles 12 and 14 carrying high pressure vessels 16 and 18 thereon, and having motorized cabs 20 and 22 connected thereto. It is important in the present invention that at least one of the two high pressure vessel means A or B be movable, by train, watercraft or, as shown in the drawings, by truck, so that it can be utilized to transport discrete batches of natural gas from a supply terminal (not shown) to the user terminal 4. There must be at least two pressure vessel means A and B, in order to practice the invention; however, in many instances additional pressure vessel means will also be utilized.

Should it be desired to utilize a stationary pressure vessel means at the user terminal 4, such can take many forms. In one form, the stationary pressure vessel means can simply be a parked simitrailer 12 or 14, which is not moved. Or it can be a large pressure tank, a series of interconnected tanks, a length of pipeline, or any other suitable arrangement designed to hold a sufficient quantity of natural gas. The stationary pressure vessel means must, of course, be filled with natural gas from time to time, and preferably be large enough to offer a reserve supply in case of inclement weather, equipment breakdown of the movable pressure vessel means or some other system components, or a like emergency situation.

The decision on whether or not to utilize a stationary pressure vessel means can include many factors, including the expected permanency of the user facility, and the amount of natural gas which must be transported to it. In some situations the use of only movable pressure vessel means will prove more desirable, and it is this arrangement which is illustrated in FIG. 1.

Figure 2:
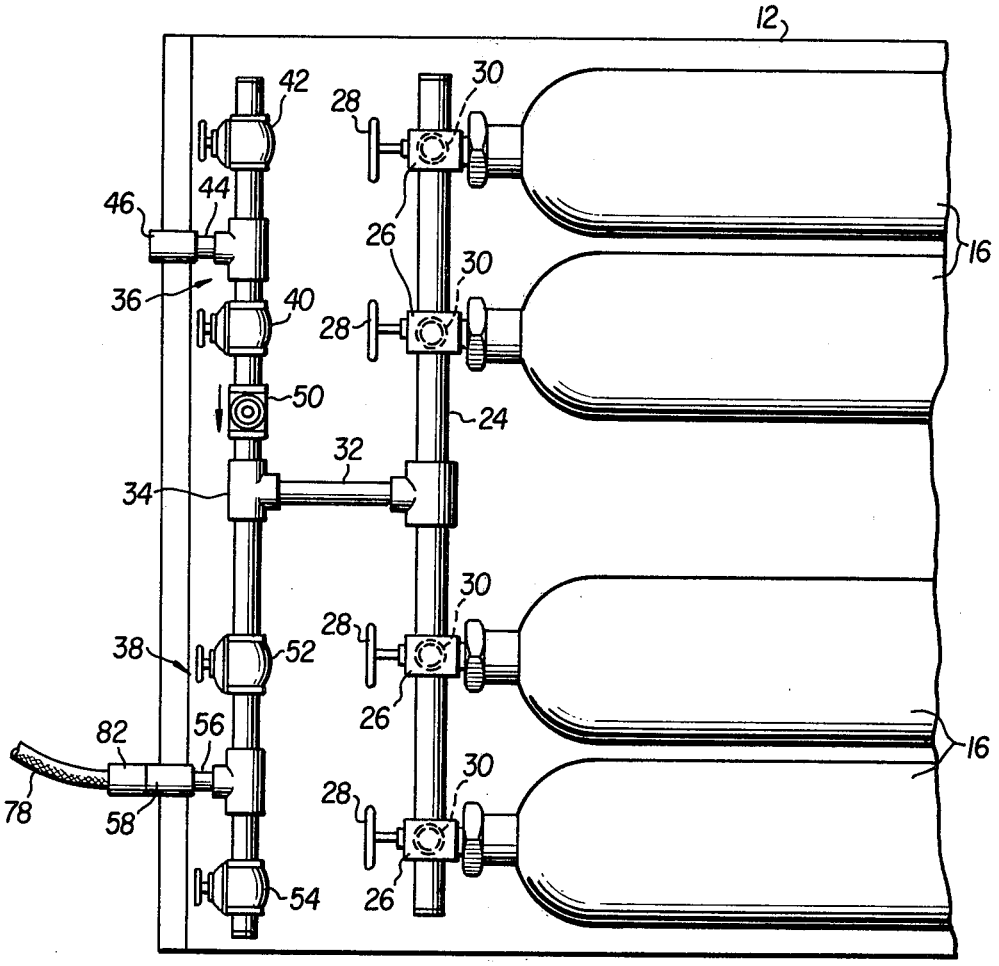
FIG. 2 is an enlarged, fragmentary diagrammatic view showing the loading and off-loading manifold arrangement associated with the high pressure vessels.

In accordance with the teachings of U.S. Pat. No. 4,139,019 and our prior U.S. patent application Ser. No. 011,683, the pressure vessels 16 and 18, comprising the pressure vessel means A and B, must be capable of safely confining a discrete batch of natural gas at pressures up to about 3,000 psi and above. Usually, a number of cylindrical pressure vessels 16 and 18 will be mounted on each vehicle, all of which will be connected to a common manifold arrangement. Referring now to FIG. 2, the high pressure vessels 16 are all shown connected to a vessel manifold 24 by individual valves 26 provided with turning handles 28, and each including a rupture disk 30 or other suitable safety device to provide emergency pressure relief in case overpressurization should occur while the associated valve 26 is closed. While the illustrated valves 26 are manually operated, it is to be understood that automatically operated valves might instead be employed, if desired.

The vessel manifold 24 has a transfer conduit 32 connected thereto, the outer end of which carries a fitting 34. A loading conduit system 36 is connected to one side of the fitting 34, and an off-loading conduit system 38 is connected to the other side thereof. The loading conduit system 36 includes a flow control valve 40, a bleed valve 42, and an inlet stub 44 disposed therebetween which carries one-half 46 of a coupling 48. A one-way check valve 50 is positioned between the flow control valve 40 and the fitting 34 to prevent backflow.

The off-loading conduit system 38 includes a flow control valve 52 and a bleed valve 54, between which is positioned a discharge stub 56 carrying one-half 58 of a coupling. The arrangement of the loading and off-loading conduit systems 36 and 38 are like those in U.S. Pat. No. 4,139,019, and function in the same manner as described therein. Further, the pressure vessels 18 of the pressure vessel means B are fitted with comparable loading and off-loading conduit systems 36' and 38' including flow control valves 40' and 52', bleed valves 42' and 54', a check valve 50', and coupling halves 46' and 58'.

As noted in U.S. Pat. No. 4,139,019, the purpose for the bleed valves 42, 42', 54 and 54' is to relieve pressure in the system before uncoupling occurs. It would be possible to eliminate the loading conduit system 36 and 36' and rely only on the off-loading conduit systems 38 and 38' to perform both loading and off-loading functions. However, the separate loading conduit systems with their additional couplings and the check valves 50 and 50' provide additional safety, in that a ruptured loading line will not cause the high pressure vessels to exhaust, since the check valves would stop the flow. It may be desirable to add further relief devices to the system for additional backup safety purposes.

Returning now to FIG. 1, the off-loading manifold 6 includes a supply manifold 60 connected to supply natural gas to a feed conduit 62, which leads to the user terminal 4. The supply manifold 60 has supply conduits 66 and 68 connected to its opposite ends, which lead to the off-loading stations 8 and 10, respectively. Two cutoff valves 70 and 72 are positioned in the supply manifold 60, one on each side of the feed conduit 62, and serve to control natural gas flow from the off-loading stations 8 and 10. One-way check valves 74 and 76, respectively, are positioned in the supply conduits 66 and 68, and the conduits 66 and 68 respectively terminate in flexible or adjustable unloading lines 78 and 80 that have coupling halves 82 and 84 on their outer ends for mating with the coupling halves 58 and 58'. The check valves 74 and 76 prevent backflows, and between the check valves and the unloading lines 78 and 80 the supply conduits 66 and 68 each have a bleed valve 86 or 88 and a pressure relief valve 90 or 92, respectively, connected thereto. The bleed valves 86 and 88 are used to relieve pressure within the system after the associated cutoff valve 70 or 72 is closed, and before the coupling halves 82,58 or 84,58' are uncoupled.

The couplings used between the unloading lines 78 and 80 and the off-loading conduit systems 38 and 38' are a matter of choice, but preferably such will be of the quick connect-disconnect type. The pressure relief valves 90 and 92 are backup, the operating pressure therefor being set at a level to assure safety for the system and its operators.

Figure 3:
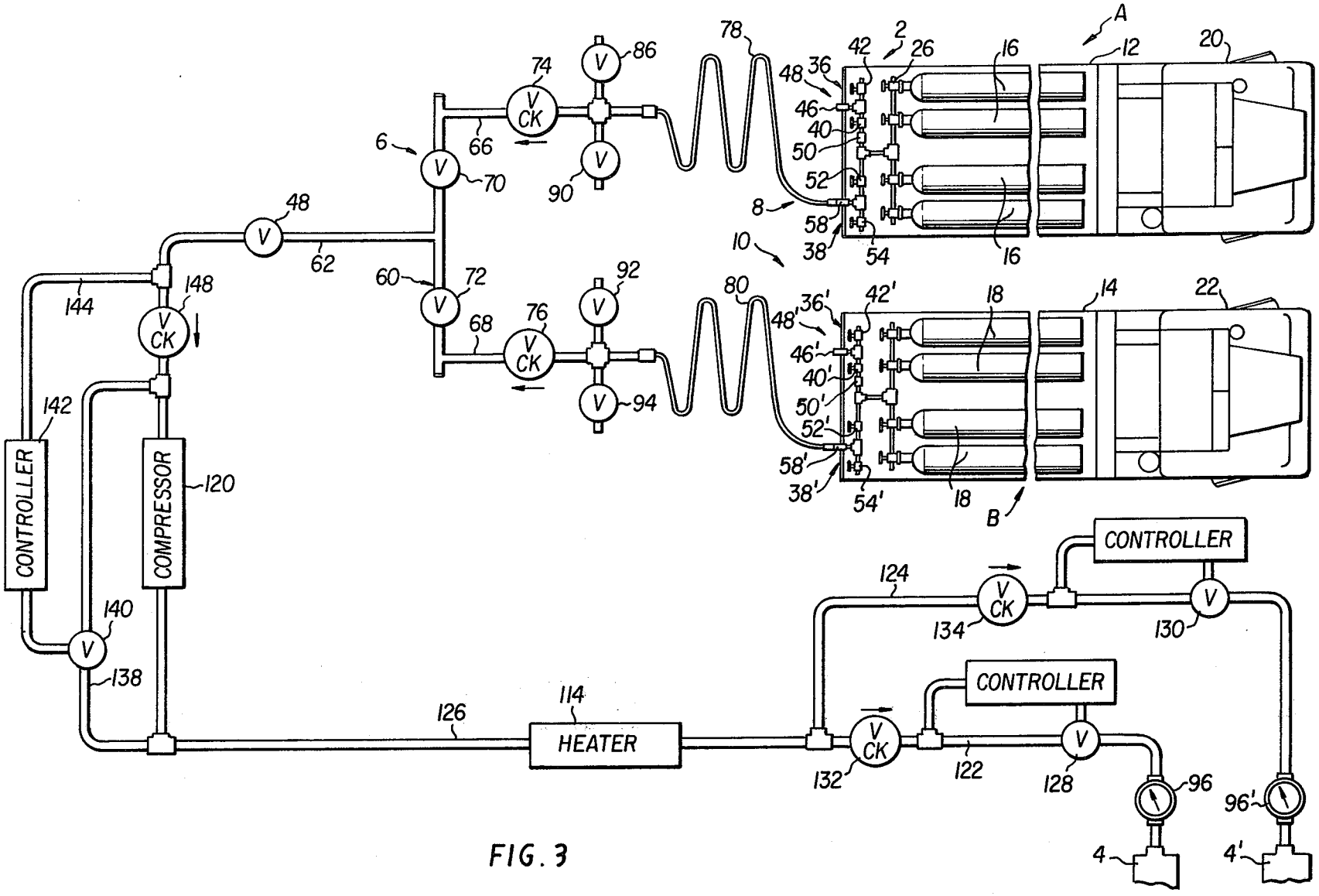
FIG. 3 is a diagrammatic view similar to FIG. 1, but showing a modified off-loading terminal incorporating a compressor arrangement for scavenging the natural gas from the pressure vessel means, the compressor arrangement including a bypass conduit having a flow control valve controlled by upstream pressure.

The off-loading manifold system is identical in FIGS. 1 and 3 of the drawings, as are the arrangements of the high pressure vessel means A and B, and the off-loading conduit systems 38 and 38'. Thus, these elements of the system will not be further described herein.

Turning now to the distribution manifold system 64 of FIG. 1, such includes a distribution conduit 94 which is connected to the user terminal 4 through appropriate gauging equipment 96. The equipment 96 can include pressure measuring apparatus, a flow meter, or both thereof. The inlet of a main shutoff valve 98 is connected to the feed conduit 62 to control the flow of natural gas from the supply manifold 60, and the outlet of the shutoff valve 98 is connected with the distribution conduit 94.

The assumption in FIG. 1 is that the user terminal 4 will flow natural gas at a pressure sufficiently low to allow at essentially all times for the unaided off-loading of high pressure natural gas from the pressure vessel means A and B. That is, whereas the pressure in the pressure vessel means A and B will normally be in the 2,000 to 3,000 psi range, the pressure of the user terminal will usually be below about 100 psi, and preferably in the range of between about 50 psi and about 200 psi. Under these conditions, no mechanical compression of the natural gas is required to transfer it from the supply manifold 60 to the user terminal 4. But it is necessary in order to meet the objectives of the invention concerning efficiently meeting demand and at the same time conserving energy and providing a safe operating environment, that the flow rate of the natural gas be carefully controlled to conform to the distribution plan.

In order to control the pressure of the natural gas being supplied to the user facility 4 from the pressure vessel means A and B in FIG. 1, a flow regulating valve 100 is positioned in the distribution conduit 94, the regulating valve 100 being controlled by a controller 102 connected thereto and which includes a pressure tap line 104 connected with the distribution conduit 94 downstream of the regulating valve 100.

The pressure regulating valve 100 can be of any suitable design, of the type which in effect functions as a variable orifice. A suitable valve is the commercially available "Fisher D Globe Style Valve", with a "4100 Series Controller", configured in the pressure regulation arrangement. The pressure regulating valve 100 is necessary to carry out the method of the invention in part because when the pressure vessel means A and B are full, the differential pressure between the user terminal 4 and the pressure vessel means is usually so great that, if applied directly to the user terminal 4, it could create a safety hazzard, damage connected equipment, and cause other serious problems. The pressure regulating valve 100 compensates for these potential problems by opening and closing to keep the flow of natural gas to the user terminal 4 approximately constant at an acceptable pressure level, thus preventing either excessive pressures in the first part of the off-loading operation, or excessively slow off-loading during the last portion. Further, the pressure regulating valve 100 accommodates variations in the demand for natural gas by the user terminal, assuring efficient operation.

A high pressure safety cutoff valve 108 is positioned between the regulating valve 100 and the user terminal 4, preferably near the user terminal. The valve 108 is operated by a controller 110, provided with a pressure tap line 112 that connects with the distribution conduit 94 upstream of the valve 108. The high pressure cutoff valve 108 is designed to shut down if the pressure in the distribution conduit 94 exceeds the safe off-loading pressure for the user terminal 4.

Usually, the natural gas transported to the off-loading stations 8 and 10 in the pressure vessel means A and B will be relatively pure and free from moisture and liquid petroleum or the like. Thus, installations are usually not required at a user terminal for removing these impurities. If they are needed, however, it is to be understood that a dehydrator and an oil-gas separator could be installed in the system of FIG. 1, preferably in the supply manifold 60 or the feed conduit 62, before the main shutoff valve 98.

The system of FIG. 1 also includes a heater 114, positioned after the pressure regulating valve 100. The heater 114 will normally be employed to heat the natural gas, so that the temperature thereof is sufficiently high before it enters the user terminal that low temperature embrittlement of equipment downstream of the heater 114 will be avoided. In some instances, the heater 114 can be eliminated, but usually its presence will be necessary for successful practice of the invention.

There are some user terminals which will operate at a pressure significantly above the preferred range of about 50 to about 200 psi, say at or above the pressure of the natural gas in the pressure vessel means A and B, and this can cause difficulty in off-loading natural gas from the pressure vessel means. In these instances, it will be necessary to add a compressor to the system, and such an arrangement is shown in FIG. 3. These components of the system which are the same in FIGS. 1 and 3 bear the same reference numbers.

Referring now to FIG. 3, a plurality of user facilities are shown at 4 and 4', equipped with gauging equipment 96 and 96', respectively, and connected with branch distribution conduits 122 and 124 that are in turn connected with a main distribution conduit 126. One-way check valves 132 and 134 are positioned in the branch distribution conduits 122 and 124, respectively, and downstream thereof are positioned high pressure safety cutoff valves 128 and 130, corresponding to the cutoff valve 108 in FIG. 1, and connected to operate in the same manner. A heater 114 is normally connected in the main distribution conduit 126, upstream of the branch distribution conduits 122 and 124 and, as in FIG. 1, it can be eliminated under certain operating conditions.

The multiple user terminal, branch distribution conduit system of FIG. 3 is of course illustrative only, in that many more user terminals might also be connected to a single distribution conduit 126, if desired. The same multiple arrangement can also be employed in FIG. 1, if desired.

The system of FIG. 3 includes a compressor 120 and, because of the presence thereof, the flow regulating valve 100 of FIG. 1 is not required in FIG. 3. The compressor 120 is connected in the main distribution conduit 126, between the main shutoff valve 98 and the heater 114, and the one-way check valve 148 is positioned upstream thereof. A bypass line 138 is connected around the compressor 120 between the inlet and outlet ends thereof, and contains a flow control dump valve 140 which is operated by a controller unit 142, the latter including a pressure tap line 144 which connects with the main distribution conduit 126 upstream of the bypass line 138 and the one-way check valve 148.

The compressor 120 is placed in operation to scavenge natural gas from the pressure vessels of the connected pressure vessel means A and B, and also functions to regulate the flow of the natural gas to the connected user terminals. It is intended in the invention that the off-loading operation will be substantially continuous, with changeover from one pressure vessel means to another occurring as the first empties, with no break in the flow of natural gas. However, it is recognized this might not always occur, for one reason or another, so that some time delay will be present after a pressure vessel means is emptied and before the next one is connected and placed in operation. In such an instance, the compressor bypass line arrangement of the invention comes into use.

Pressure within the feed conduit 62 will start to reduce as the pressure vessel means connected to the off-loading manifold system 6 empties. When this pressure falls below a predetermined value as set on the controller unit 142 and sensed by the pressure tap line 144, the normally closed dump valve 140 will be shifted to its open position, causing the bypass line 138 to begin operation and placing the compressor 120 in an easy idle mode. The compressor will go into an easy idle mode because when the dump valve 140 snaps open, the vacuum of the discharge of the compressor 120 is completely relieved, the one-way check valve 148 being chosen so that under such conditions it prevents any feedback of pressure from the pressure vessel means or the loading manifold system 6. The compressor 120 will operate in this easy idle mode, with minimum wear and using a minimum of energy, until the dump valve 140 is again closed.

When pressure upstream of the check valve 148 is raised sufficiently, as for example when a full pressure vessel means is again connected to the system, such will be sensed by the controller unit tap line 144, and the dump valve 140 will be closed. The compressor 120 will then again be operational to supply natural gas under pressure to the user terminals, drawing it through the check valve 148. The bypass arrangement helps ensure that underpressurization of the off-loading manifold system 6 and the pressure vessel means will not occur, preventing the leakage of air into the system which might otherwise occur under a vacuum caused by the compressor 120.

As noted, it is preferred that the flow from the pressure vessel means into the distribution conduit be uninterrupted. This requires a substantially simultaneous switch from an emptying pressure vessel means to a pressure vessel means having an adequate supply of natural gas available. Usually, an operator can manually operate the control valves 70 and 72 of the off-loading manifold system 6 to change from an empty to a fuller pressure vessel means, with no significant interruption of natural gas flow. However, it is preferable if this switchover can be made automatically, at a desired point in the emptying cycle for the first pressure vessel means. This can assure a smoother, more efficient operation and, in addition, will safely accommodate those instances when an operator may not be available for or capable of a manual switchover.

Figure 4:
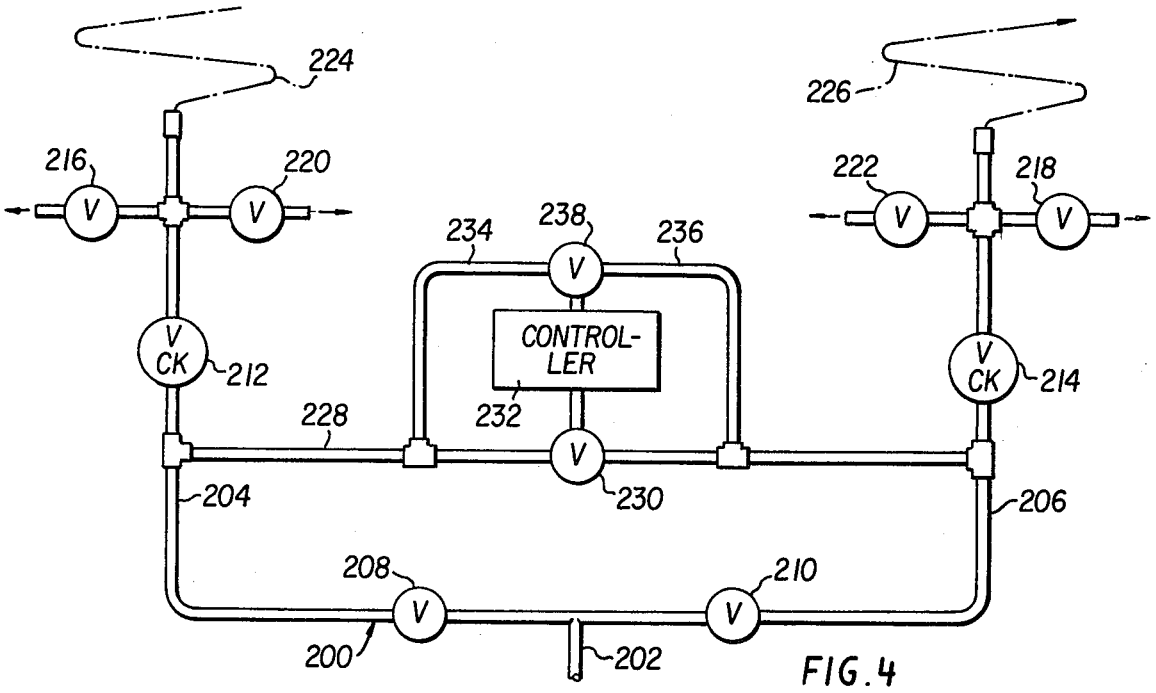
FIG. 4 is an enlarged, fragmentary diagrammatic view showing the automatic switchover off-loading arrangement of the invention.

Referring now to FIG. 4, there is shown an arrangement for effecting an automatic switchover from an empty pressure vessel means to a fuller one. In said FIG., a loading manifold 200 is shown connected with a feed conduit 202, and having supply conduits 204 and 206 connected to its opposite ends. The manifold 200 is provided with flow control valves 208 and 210, corresponding to the flow control valves 70 and 72, and the supply conduits have check valves 212 and 214, bleed valves 216 and 218, and pressure relief valves 220 and 222, respectively, connected thereto, corresponding to the check valves 74 and 76, bleed valves 86 and 88, and pressure relief valves 90 and 92 of FIG. 1. Off-loading lines 224 and 226, respectively, are connected to the outer ends of the supply conduits 204 and 206.

A connecting conduit 228 extends between the supply conduits 204 and 206, and is connected with each thereof between the associated check valve 212 or 214, and the flow control valve 208 or 210. Centrally thereof, the connecting conduit 226 has a switchover control valve 230 therein, operated by a controller unit 232 provided with two pressure tap lines 234 and 236, which are connected to the connecting conduit 228 on opposite sides of the switchover valve 230. The pressure tap lines 234 and 236, respectively, connect to a selector valve 238, which is arranged to sense the lowest pressure of the two tap lines 234 and 236 and to permit flow only toward the controller unit 232.

The switchover control valve 230 is initially closed, and pressure vessel means are connected to both of the off-loading lines 224 and 225. Thereafter, the shuttle check valve 238 senses the lowest of the two operating pressures which exist in the supply conduits 204 and 206 and, when the pressure in one of them falls below the setting of the controller unit 232, such is effective to open the switchover valve 230. Flow then is directed from the higher pressure supply conduit 204 or 206 to the lower pressure one, with the appropriate check valve 212 or 214 preventing any backflow into the just emptied pressure vessel means. Thus, the system is automatically switched from the emptying to the fuller pressure vessel means.

At some time after switchover occurs, the flow control valve 208 and 210 which normally supplies natural gas to the feed conduit 202 from the now being emptied pressure vessel means is opened, whereby the normal delivery of natural gas is established, and the other control valve 208 or 210 is closed. The supply conduit 206 or 208 leading from the emptied pressure vessel means is then bled by operating its associated bleed valve 216 or 218, and the fall in pressure in the associated pressure tap line 234 or 236 will be sensed by the controller unit 232 and the switchover valve 230 will close. The empty pressure vessel means is then replaced, and the system will thereafter continue in operation until the second pressure vessel means empties sufficiently, when the switchover cycle will again automatically occur.

The switchover arrangement of FIG. 4 helps assure a smooth transition from an empty to a full pressure vessel means, with no measurable interruption in the continuity of natural gas flow. Thus, it helps to meet one of the goals of the invention. Further, because the actual switchover occurs automatically, the operator need not be overly attentive to the system and, indeed, is provided with a considerable time period during which to change pressure vessel means. This contributes to the safety of the overall system and, more importantly, makes it possible to to accommodate widely varying demand situations that will occur from time to time.

Turning again to the method of the invention, if correctly practiced it will assure the minimum disruption of natural gas flow to the user terminal. The first step of the method is to analyze the user demand to determine what the preferred rate of supply of natural gas thereto ought to be. To do this analysis, factors like the rate of use of natural gas by connected user equipment, variations and fluctuations expected in the weather, variations occurring during the work week and vacation periods, and similar matters must be reviewed and evaluated. The technique for accomplishing this analysis are known in the industry.

Given the results of this review and evaluation, a maximum rate of supply for the user terminal is selected. This will commonly be in the range of from about 2 to 3 times the average consumption rate of the user system. It should also be noted that the preferred rate of supply can change over a period of time, and thus a periodic review is desirable to ensure a continued, adequate natural gas supply.

The next step of the method is to determine the preferred rate of production of natural gas from the supply terminal. The number of factors to be taken into account in this step will depend upon the nature of the supply terminal, and especially upon how natural gas is supplied to it. In some instances, the capacity of the supply terminal may be practically limitless. In others, the production may be limited.

Having selected a preferred rate of supply and a preferred rate of production, the next step in the method is to select the preferred number of separate pressure vessel means, and the mode of their operation required to satisfy the demand and accommodate the production capability of the supply terminal. In most instances, a separate pressure vessel means is defined as a vehicle of suitable design, movable from place to place, and which carries thereon one or more high pressure vessels arranged as described herein. The minimum number of separate pressure vessel means required to practice the invention is two; sometimes, however, one or several additional separate pressure vessel means may be required for continuity of supply to the user terminal, or to satisfy the conditions surrounding a given transport situation. At least one separate pressure vessel means must be movable, as has been noted earlier.

There are several factors which must be taken into account when selecting the number of separate pressure vessel means and their mode of operation. These include the holding capacity of the separate pressure vessel means at the selected operating pressure, which will usually be between about 2,000 psi and 3,000 psi, the distance from the supply terminal to the user terminal(s), the rate at which off-loading will occur at the user terminal, the travel conditions and time required between the supply terminal and the user terminal, and similar factors. In each case, a production plan must be produced which will assure that the user facility is adequately and continuously supplied with natural gas.

The type of vehicles used in the movable separate pressure vessel means can be trucks, watercraft, aircraft, or possibly a combination of these. Usually, however, transport will be on land, by truck. Considering for the moment the semitrailer mounted pressure vessels shown in the drawings, the minimum amount of equipment for practicing the present method would usually be two such semitrailers with their pressure vessels, and one motor cab to move them over the road. For isolated areas and user facilities with a small demand for natural gas, and when short haul distances are present, this minimum system might well suffice. Further, as has been noted, it is possible that only one separate pressure vessel means would be movable and the other fixed; the necessary switchover to provide continuous gas flow is not affected with this arrangement, if the fixed, separate pressure vessel means itself is periodically filled with natural gas.

To determine the adequacy of the equipment, one must calculate the following:

(1) The time required to fill a separate pressure vessel means; and (2) The cycle time required for an unloading operation, which includes:

a. the time required to unhook a movable filled separate pressure vessel means from the supply terminal and ready it for travel;
b. the travel time to and from the user terminal;
c. the time required to unload at the user terminal, which is of course controlled by the rate at which the user terminal demands the natural gas; and
d. the time required to connect an empty, movable separate pressure vessel means after it has been returned to the supply terminal.

If the off-loading cycle time is well within the filling time, with some margin for delays, then the minimum amount of equipment will suffice. If not, then normally more vehicles with pressure vessels thereon, each defining a movable separate pressure vessel means, will be required. Among ways in which the tractor-trailer system can be enlarged are the following which, again, are merely offered as examples:

Alternate System A
3 semitrailers with one motor cab
Alternate System B
4 semitrailers with two motor cabs There are of course other variations which can be employed, such as four on six semitrailers with three or five motor cabs. In each situation, the goal is to minimize costs, while keeping the user terminal(s) supplied adequately with natural gas, and staying within the production capability of the supply terminal.

Once the data for the user terminal and the supply terminal have been analyzed, and the number of pressure vessel means and their mode of operation have been selected, the information is integrated into a distribution plan. The distribution plan must also include a selection of the off-loading system to be employed at the user terminal, including a decision on the need for a compressor. With the distribution plan established, the next step of the method is to load a first, full pressure vessel means, and connect it to the user terminal. Then, the second pressure vessel means is loaded with a discrete batch of natural gas, and is connected to the user terminal and readied for a switchover. When the first pressure vessel means empties to a selected point, a switchover to the second pressure vessel means is made with no discernable interruption of natural gas flow, and the first pressure vessel means is then refilled with natural gas to the extent required by the distribution plan. During off-loading, natural gas is moved from the connected pressure vessel means to the user terminal, the flow thereof being regulated to accommodate the demand of the user terminal, and the natural gas normally being heated during such movement.

When all of the separate pressure vessel means are movable, they are usually transported to the supply terminal for filling. If one or more of the separate pressure vessel means is stationary at the user terminal, it of course must be refilled periodically at the site of the user terminal, preferably by the use of a movable pressure vessel means.

After a switchover has occurred, the final step of the method is to replace the empty separate pressure vessel means with a full separate pressure vessel means, to ready the process for a new operating cycle.

In those instances when only two separate pressure vessel means are employed and one thereof is fixed at the terminal facility, the switchover from the first, empty, movable separate pressure vessel means is made in the usual manner, and the empty, movable separate pressure vessel means is then removed and transported to the supply terminal. After filling, it is returned to the user terminal and reconnected. If the cycle time is short compared to the holding capacity of the fixed pressure vessel means, this refilling operation can be repeated several or more times before the fixed separate pressure vessel means must itself be refilled. The time between filling operations of the fixed separate pressure vessel means can be extended if the duration of its connection to the user terminal is minimized, and this can sometimes be done by simply switching over to the movable separate pressure vessel means as soon as it is reconnected.

By increasing the number of movable separate pressure vessel means, it is possible to even further extend the time between fillings of the fixed separate pressure vessel means. In the instances just described, the fixed separate pressure vessel means is used essentially to maintain continuous flow to the user terminal.

It should be noted that the present invention utilizes the high pressure transport technique of U.S. Pat. No. 4,139,019, which means that the pressure vessel means are not refrigerated, nor is the natural gas which is carried therein. Rather, the natural gas is transported in discrete batches at a pressure of at least 800 psi, preferably about 1,500 psi, and usually in the range of from about 2,000 to 3,000 psi. It is the transportation method of this patent which helps make possible the present invention, in part because this transportation technique for natural gas is both effective and economically sound.

As has been noted, the switchover step can be performed manually, but preferably it is accomplished automatically, utilizing the system of FIG. 4.

Obviously, many modifications and variations of the invention are possible. Further, it is evident the method and system as described herein meet the objects set forth hereinabove, and that the invention makes possible the distribution of natural gas in a continuous uninterrupted and adequate fashion to user facilities which are not connected with a pipeline.

We claim :

1. A system for continuously distributing natural gas from a supply terminal to a user terminal in an amount adequate to assure the maintenance of a preselected, preferred rate of supply to said user terminal, including:

at least two separate pressure vessel means, at least one of which is movable between said supply terminal and said user terminal, and both of which are capable of containing a discrete batch of natural gas under a pressure in excess of about 800 psi, the specific number of separate pressure vessel means being chosen in accordance with a distribution plan that takes into account the preferred rate of natural gas production from said supply terminal and the selected rate of supply of natural gas to said user terminal, and being adequate to assure the maintenance of said selected rate of supply said separate pressure vessel means being initially filled with natural gas at said supply terminal; and an off-loading manifold system connected with said user terminal, and including:

at least two off-loading stations, for simultaneously receiving said separate pressure vessel means;

at least two supply conduit means, one for each of said off-loading stations, said supply conduit means being connectable with said separate pressure vessel means;

a one-way check valve in each of said supply conduit means, arranged to prevent a backflow of natural gas therethrough;

an off-loading manifold connected with said two supply conduits downstream of said check valves;

a feed conduit connected with said off-loading manifold between said two supply conduit means;

distributor conduit means connected with said feed conduit, and with said user terminal;

means connected in said distributor conduit means for regulating the flow of natural gas therethrough;

valve means for controlling the flow of natural gas from said supply conduit means to said user terminal; and means located downstream of said check valves arranged and operable to switch natural gas flow from a first separate pressure vessel means connected with a first one of said supply conduit means, to natural gas flow from a second separate pressure vessel means connected with the other of said supply conduit means, with no significant interruption of natural gas flow to said user terminal to assure the maintenance of said selected rate of supply.

2. A system for continuously distributing natural gas from a supply terminal to a user terminal, including:

at least two separate pressure vessel means, at least one of which is movable between said supply terminal and said user terminal, and both of which are capable of containing a discrete batch of natural gas under pressure;

means at said supply terminal for loading a discrete batch of natural gas into said separate pressure vessel means, at a pressure in excess of about 800 psi; and an off-loading manifold system connected with said user terminal, and including:

at least two off-loading stations, for simultaneously receiving said separate pressure vessel means;

at least two supply conduit means, one for each of said off-loading stations, said supply conduit means being connectable with said separate pressure vessel means;

an off-loading manifold connected with said two supply conduit means;

a feed conduit connected with said off-loading manifold between said two supply conduit means;

distributor conduit means connected with said feed conduit, and with said user terminal;

means connected in said distributor conduit means for regulating the flow of natural gas therethrough;

valve means for controlling the flow of natural gas from said supply conduit means to said user terminal, including a pair of flow control valves mounted in said off-loading manifold, one between said feed conduit and each of said supply conduit means; and means connected between said two supply conduit means, arranged to automatically switch natural gas flow from a first separate pressure vessel means connected with a first one of said supply conduit means, to natural gas flow from a second separate pressure vessel means connected with the other of said supply conduit means, in response to a decline in pressure below a preselected value within said first supply conduit means, said automatic switching means including:

a connecting conduit extending between and connected at its opposite ends with said two supply conduit means;

a one-way check valve in each of said supply conduit means, upstream of said connecting conduit;

a switchover valve connected in said connecting conduit;

a controller for said switchover valve, including two pressure tap lines connected with said connecting conduit on opposite sides of said switchover valve; and a selector valve located between said pressure tap lines, arranged to permit pressure to be sensed from the supply conduit means in use, and connected with said controller.

3. A system for continuously distributing natural gas as recited in claim 2, including additionally:

connector means carried on the outer ends of each supply conduit means, for detachably connecting such with an associated separate pressure vessel means; and a bleed valve connected with each supply conduit means between the said connector means and the said flow control valve associated therewith, located upstream of the associated one of said check valves.

4. A system for continuously distributing natural gas as recited in claim 2, wherein said means for regulating the flow of natural gas through said distributor conduit means is a flow regulating valve, operated by a controller utilizing pressure tapped downstream of said regulating valve.

5. A system for continuously distributing natural gas as recited in claim 2, wherein said means for regulating the flow of natural gas through said distributor conduit means includes a compressor.

6. A system for continuously distributing natural gas as recited in claim 2, including additionally:

heater means connected in said distributor conduit means, upstream of said user terminal.

7. A system for continuously distributing natural gas as recited in claim 2, including additionally:

a high pressure safety valve connected in said distributor conduit means upstream of said user terminal, and including a controller having a pressure tap line connected with said distributor conduit means downstream of said high pressure safety valve.

8. A system for continuously distributing natural gas from a supply terminal to a user terminal, including:

at least two separate pressure vessel means, at least one of which is movable between said supply terminal and said user terminal, and both of which are capable of containing a discrete batch of natural gas under pressure;

means at said supply terminal for loading a discrete batch of natural gas into said separate pressure vessel means, at a pressure in excess of about 800 psi; and an off-loading manifold system connected with said user terminal, and including:

at least two off-loading stations, for simultaneously receiving said separate pressure vessel means;

at least two supply conduit means, one for each of said off-loading stations, said supply conduit means being connectable with said separate pressure vessel means;

an off-loading manifold connected with said two supply conduit means;

a feed conduit connected with said off-loading manifold;

distributor conduit means connected with said feed conduit, and with said user terminal;

means connected in said distributor conduit means for regulating the flow of natural gas therethrough, including a compressor means, said compressor means including:

a compressor connected in said distributor conduit means;

a bypass line connected with said distributor conduit means, and connecting the outlet side of said compressor with the inlet side thereof;

dump valve means located in said bypass line;

a controller for said dump valve means, including a pressure tap line connected with said distributor conduit means upstream of said compressor; and a one-way check valve positioned upstream of said compressor in said distributor conduit means, between said pressure tap line and the inlet of said compressor; and valve means for controlling the flow of natural gas from said supply conduit means to said user terminal.

9. A system for continuously distributing natural gas as recited in claim 8, wherein said feed conduit is connected with said off-loading manifold between said two supply conduit means, and wherein said valve means includes a pair of flow control valves mounted in said off-loading manifold, one between said feed conduit and each of said supply conduit means.

10. A system for continuously distributing natural gas as recited in claim 9, including additionally:

means connected between said two supply conduit means, arranged to automatically switch natural gas flow from a first separate pressure vessel means connected with a first one of said supply conduit means, to natural gas flow from a second separate pressure vessel means connected with the other of said supply conduit means, in response to a decline in pressure below a preselected value within said first supply conduit means.

* * * * *